US005286021A

United States Patent [19]

Shaw

[11] Patent Number: 5,286,021

[45] Date of Patent: Feb. 15, 1994

[54] RACQUET SPORT WARM-UP AND WEIGHT TRAINING DEVICE

[76] Inventor: Walter Shaw, 913 Stratfield Rd., Fairfield, Conn. 06432

[21] Appl. No.: 854,132

[22] Filed: Mar. 19, 1992

[51] Int. Cl.[5] ..... A63B 49/04

[52] U.S. Cl. ..... 273/73 R; 273/29 A; 273/74

[58] Field of Search ..... 273/73 R, 73 C, 29 A; 220/283, 333-343; 206/315 B; 150/52 G

[56] References Cited

U.S. PATENT DOCUMENTS

| | | | |
|---|---|---|---|
| 832,915 | 10/1906 | Lillywhite | 273/74 |
| 978,455 | 12/1910 | Johnson | 273/74 |
| 1,841,596 | 1/1932 | Halpin | 273/74 |
| 2,628,804 | 2/1953 | Goodman | 273/74 |
| 2,818,257 | 12/1957 | Allen | 273/74 |
| 3,343,838 | 9/1967 | Baukney | 273/74 |
| 3,931,967 | 1/1976 | Lyons et al. | 273/74 |
| 3,968,875 | 7/1976 | Kochnle | 273/74 X |
| 4,007,930 | 2/1977 | Straus | 273/74 |
| 4,044,934 | 8/1977 | Peters | 273/74 X |
| 4,671,510 | 6/1987 | Schoenwetter | 273/74 X |

FOREIGN PATENT DOCUMENTS

| | | | |
|---|---|---|---|
| 543927 | 1/1927 | Australia | 273/74 |
| 323229 | 12/1929 | United Kingdom | 273/74 |

*Primary Examiner*—William Stoll

*Attorney, Agent, or Firm*—Pennie & Edmonds

[57] ABSTRACT

A warm-up and weight training device for use on a sports racquet comprised of a housing which fits around the lower end of the head of the racquet, elongated members within the housing which are resiliently biased against the frame of the sports racquet thereby securing the device to the racquet, at least one supplemental weight and weight retaining clips for securing the weight(s) within the housing unit.

15 Claims, 4 Drawing Sheets

RACQUET SPORT WARM-UP AND WEIGHT TRAINING DEVICE

BACKGROUND OF THE INVENTION

The present invention generally relates to sports and, more particularly, to a device for warming-up and training for racquet sports such as tennis, squash, racquetball, badminton and ping-pong.

"Warming-up" and weight training safely and effectively enhance racquet sport performance. Typically, tennis players warm-up by practicing their strokes—forehand, backhand, service and overhead—before participating in competition. Practice strokes tend to increase blood flow to the necessary muscles in the shoulder and arm therefore increasing freedom of movement and flexibility, while decreasing susceptibility to muscle strain or similar injuries Warming-up is particularly important today with the advent of newer and wider racquets made of stronger materials which provide more power and stiffness. With respect to weight training, development of hand, wrist, forearm and shoulder strength prepares a player to withstand the stresses required of his body during racquet sport competition. The invention described herein, a racquet sport warm-up and weight training device, heightens the beneficial effects just described.

In connection with warming-up and training for athletic events, prior art devices are known which attach weights to a racquet or bat. These devices increase the load or resistance on the active muscle ultimately increasing the strength and flexibility of that muscle. For instance, a player can practice with the weighted device whereby he trains the muscles to endure a heavier load. Upon removing the added weight the player will experience an increase in speed and power. Such devices can also be used for muscle conditioning and development. It is known that repeating a prescribed motion develops muscle coordination and efficiency. Increasing the load on the muscle during such activity further enhances the effects of conditioning the muscle.

In such sports as baseball and golf it has been desirable in the past to use weighted attachments which directly connect to the baseball bat or golf club.

For example, U.S. Pat. No. 3,971,559 relates to a circular weight attachment known as a "batting doughnut." It is intended to be placed around the circumference of a baseball bat such that when a player repeatedly swings the bat he in turn stretches the muscles in his arms and shoulders while developing strength.

A similar device has been devised for golf clubs as shown in U.S. Pat. No. 3,716,239. This patent discloses a weighted device which attaches to the base of a golf club immediately adjacent to the club head. By repeatedly swinging a golf club having this weighted attachment the player stretches and strengthens the particular muscles associated with controlling the golf swing.

In connection with warming-up and weight training for racquet sports several devices have also been developed.

U.S. Pat. No. 3,330,560 to Higdon discloses a tennis racquet weight attachment. It is a flexible sheet of material capable of holding, on its inside surface, an added weight. This device is attached to the top of the head of a tennis racquet by tying it on with a lace or string.

U.S. Pat. No. 4,000,893 to Evans discloses a tennis racquet weight holder. This device is made of a flexible material, having two inner pockets for added weights.

The device can be attached to the throat of the racquet by overlapping the ends of the material which have Velcro, or some other method of attachment at those ends.

U.S. Pat. No. 4,052,061 to Stewart discloses a racquet weighting means. This device wraps around the throat of a tennis racquet and secures itself by Velcro or other similar attachment means.

U.S. Pat. No. 4,142,721 to Faleck et al. discloses a weight and belt assembly. This weighted device secures to the throat of a tennis racquet by passing a flexible belt through the parallel slots of a weighted plate and which is then secured with the use of Velcro or the like.

U.S. Pat. No. 4,200,285 to Petitti, Jr. discloses a racquet weight system where tubular shaped members are constructed such that they can be attached to a tennis racquet along the side-portions of the head or hitting surface area.

Finally, U.S. Pat. No. 4,538,812 to Mugford et al. discloses a weight device for athletic racquets. This device is made of two sheets separated by an elastic member. Each sheet contains a number of weights which are housed in chambers. This device can be attached to the throat of a tennis racquet and secured with Velcro.

Several problems, however, are associated with the above-identified devices For example, most of the above devices do not concentrate the added weight at the racquet's center of gravity. Typically, for a tennis racquet, the center of gravity is located near the lower portion of the hitting surface (head) of the racquet, where the throat and head meet. In order to develop strength while maintaining the "feel" — i.e. balance—of the racquet, supplemental weight should be added to the racquet's center of gravity. Only when the weight is added to the racquet's center of gravity does the moment arm to weight ratio remain unchanged. If weight is added to the head of the racquet, above the racquet's center of gravity, the moment arm to weight ratio increases and the racquet feels "head heavy". If weight is added to the throat of the racquet, below the racquet's center of gravity, the moment arm to weight ratio decreases and the racquet feels "handle heavy". Thus, to maintain the proper balance while developing hitting strength, supplemental weight should be added at the racquet's center of gravity.

The devices described above concentrate supplemental weight on either the racquet's head or throat thus disturbing the balance of the racquet. Training with these devices will improperly train the muscles in the arm to respond to a different moment arm to weight distribution. This can result in faulty timing and even change a player's stroke, which ultimately can lead to arm injuries like "tennis elbow".

Most of the above-mentioned devices are fastened onto the racquet by methods which could fail of their intended purpose. This is especially true of those devices which utilize "Velcro" which becomes less effective over time. If such fastening means fail while a player is swinging the racquet the weighted device will become a projectile capable of inflicting serious injury to person or property.

Some of the above mentioned devices are connected to the throat area of the racquet without means for preventing them from slipping down the throat onto the handle of the racquet or onto the hand of the person holding the racquet. This creates a potentially injurious circumstance to the party swinging the racquet whose hand would encounter the fall of the weighted device.

A further problem with some of the above-mentioned devices is that today's tennis racquets come in a variety of different sizes, shapes and widths. Some of the devices described above cannot adapt to fit a wide range of racquet sizes. Rather, such devices appear to be limited to smaller sized frames such as the traditional sized racquet popular many years ago but rarely used today.

Despite the existence of these racquet weighting devices, a tennis player today typically warms-up by holding and swinging two or more racquets at the same time. Although, holding more than one racquet increases the weight in the player's hand, thereby improving the warm-up and training results, it is cumbersome thereby presenting a potentially dangerous situation to person or property if the player loses his grip on one or both of the racquets.

For the above reasons, it would be particularly advantageous to develop a racquet warm-up and weight training device that concentrates supplemental weight at the racquet's center of gravity, while being securely fastened to the racquet without the possibility of releasing from the racquet frame or sliding down the racquet's throat onto the player's hand, and which is capable of fitting any and all sizes, widths and shapes of racquets. Furthermore, such a device should be weight adjustable so it can be used by players of all capabilities and strengths. It should also be compatible with the composition of all types of racquets so as not to injure the surface of the racquet. When used in conjunction with a player's training, such a device should enhance warm-ups, increase blood circulation, improve flexibility, develop muscle, lessen the incidence of injury, increase racquet speed and hitting power, and heighten racquet control.

SUMMARY OF THE INVENTION

The present invention provides a weight adjustable racquet sport warm-up and weight training device which satisfies the aforementioned needs.

The warm-up and training device of the present invention comprises a housing, a means for securing the housing to a racquet, at least one but preferably four removable weights which can be slideably secured within the housing unit and weight retaining clips for securing the weights within the housing unit. The housing includes an apertured region through which the handle and throat of a sports racquet can be passed.

The device further includes a securing means (hereinafter referred to as "spring fingers") which enables the device to be mounted on any size racquet. The spring fingers comprise elongated members which are resiliently biased against opposite sides of the frame of the racquet once the device is put into place. In particular, the spring fingers pinch the racquet frame on opposite sides of the lower portion of the racquet head on the face areas of the racquet thereby securing the device on the frame near the racquet's center of gravity. The device can also be held in place by any compliant surface attached to the inside of the device which is resiliently biased against the racquet frame. The spring fingers or inner compliant surface are constructed of or coated with a non-slip material which prevents the device from sliding down the throat of the racquet onto the player's hand.

The attachable weights are designed to be slid into and secured within an apertured region in the housing. Weight retaining spring clips are used to prevent the attachable weights from releasing from the housing during use, and provide a quick means for attaching and removing the weights from the housing.

BRIEF DESCRIPTION OF THE PREFERRED EMBODIMENT

The device embodied by this invention can be constructed in different sizes to accommodate the different sizes of racquets associated with each racquet sport. I will use tennis only as an example of one type of racquet sport which will benefit from the present invention.

Figure 1:
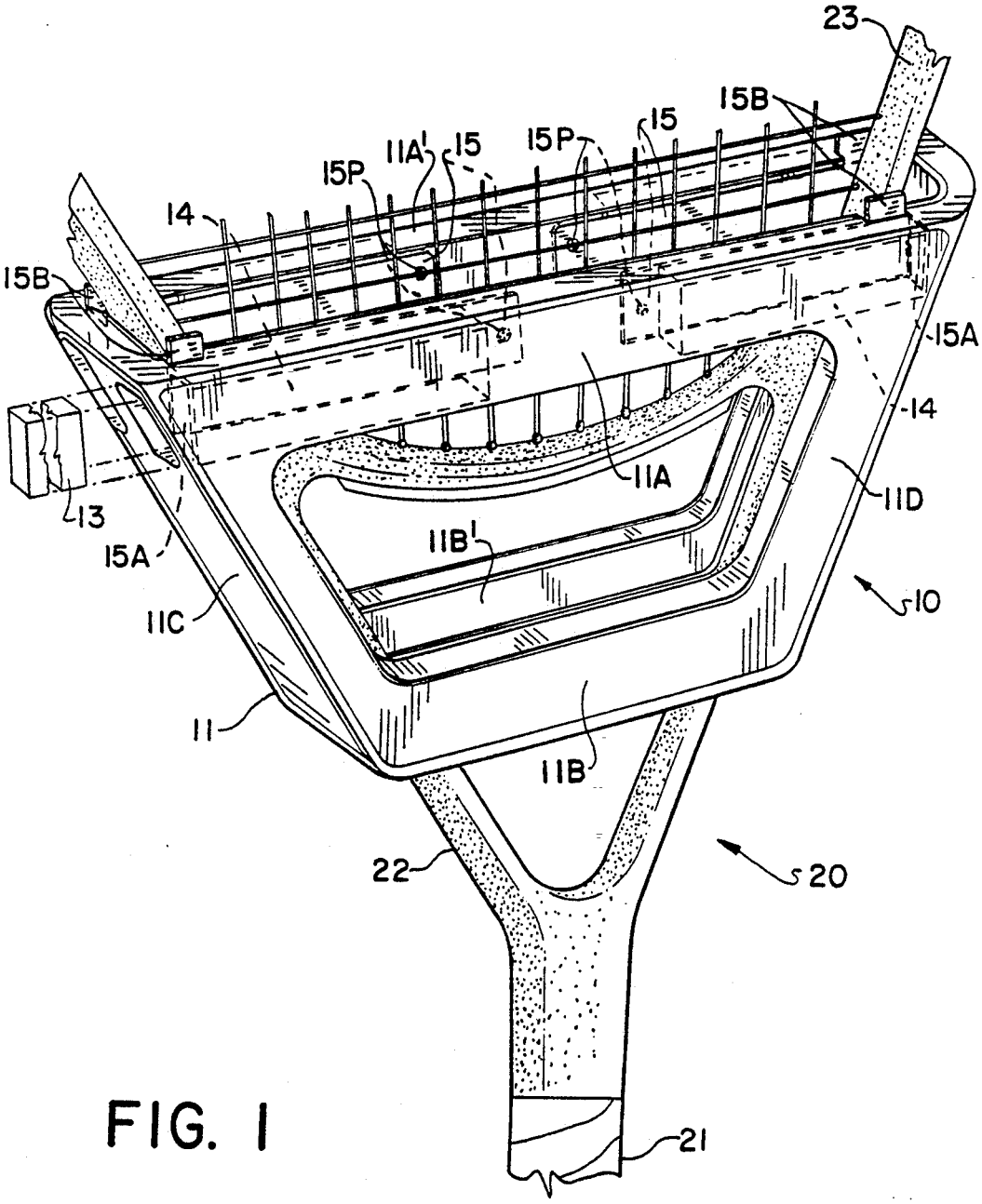
FIG. 1 is a perspective view of the warm-up and weight training device secured to a sports racquet frame.
Figure 3:
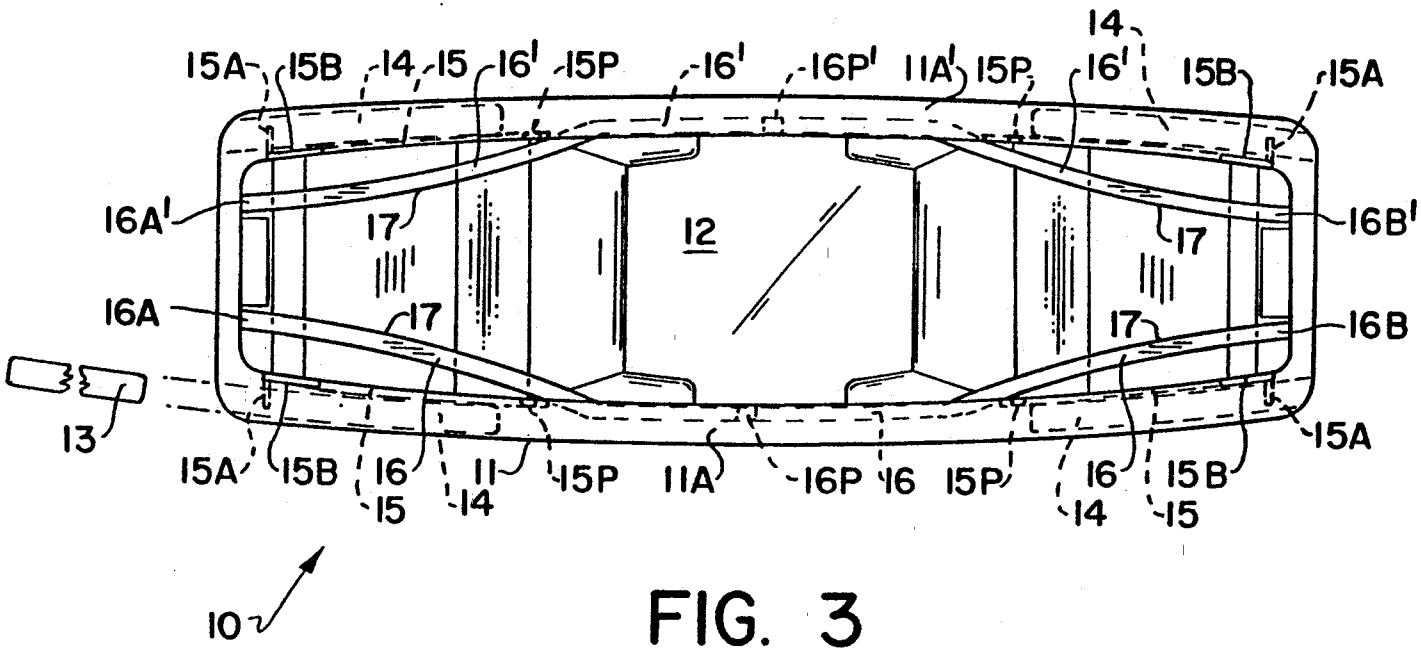
FIG. 3 is a top view of the warm-up and weight training device.
Figure 4:
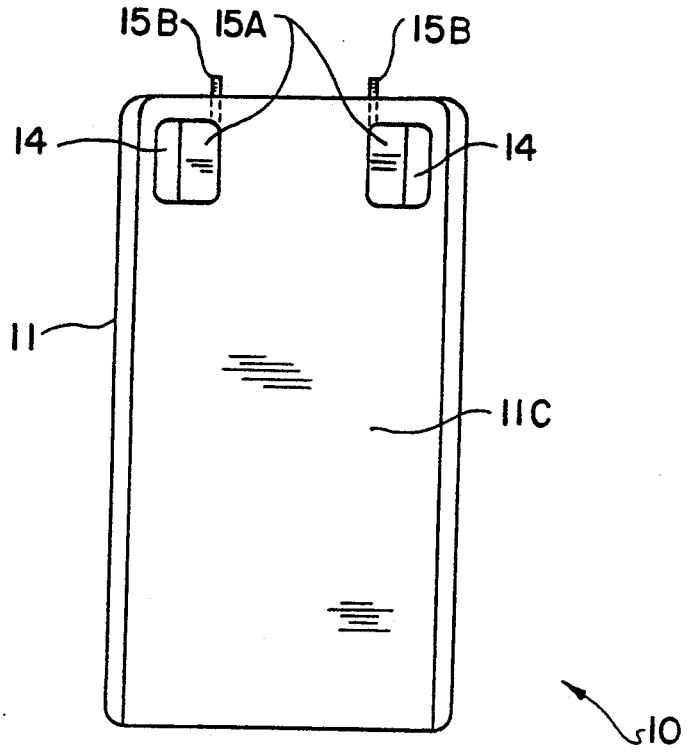
FIG. 4 is a side view of the warm-up and weight training device.

Referring now to the drawings, and more particularly to FIG. 1, there is shown a warm-up and weight training device 10 of the present invention secured to a sports racquet 20. This device comprises a housing 11 made of high-impact plastic or other suitable material. The housing il has a trapezoidal shape (although not necessary for proper use) with upper horizontal members 11A and 11A', lower horizontal members 11B and 11B', and two equal length sides—members 11C and 11D. Housing 11 is constructed such that the handle 21 and throat 22, but not the head 23, of any size tennis racquet will slide through apertured regions 12 (as shown in FIG. 3) formed in the upper and lower members, respectively, of the device. The trapezoidal shape of the device 10 ensures not only a snug fit onto any size frame 20 but also guarantees that the device 10 will not release from the frame 20 when in use upon encountering centrifugal forces normally associated with swinging a tennis racquet.

The housing 11 is preferably constructed without the permanent attachment of any additional weight. However, if a heavier device is desired, the housing can be constructed of a heavier material, or weights can be permanently secured within the housing 11.

Figure 2:
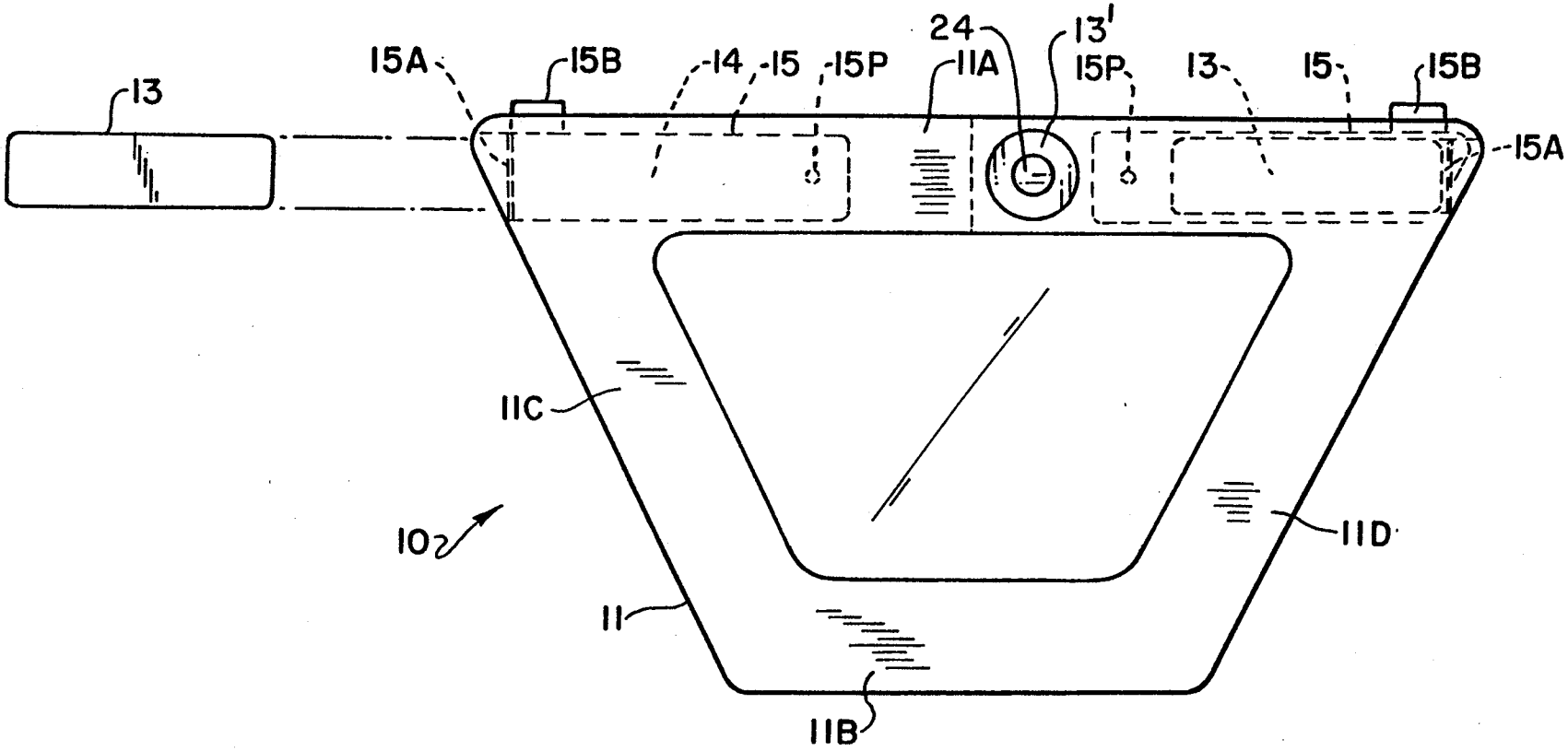
FIG. 2 is a front view of the warm-up and weight training device.

In its preferred embodiment, the housing 11 is designed to accept at least one, but preferably four, weights 13 of predetermined amount, illustratively 3–8 ounces each, although other amounts can be used. Housing 11 is designed to secure the supplemental weight to the racquet at a location at or near the racquet's center of gravity. In another embodiment, the supplemental weight can be a single weight weighing 3–30 ounces. As shown in FIGS. 1, 2 and 3, weights 13 are designed to slide into apertured regions 14 formed in the upper horizontal members 11A and 11A' where they can be secured. In other embodiments, apertured regions 14 designed to accept the weights 13 may be located elsewhere along the housing unit 11. Furthermore, the housing 11 can be designed with a single apertured region to accept one or more supplemental weights.

The weights 13 slide into and secure within the apertured regions 14 of the housing 11 through the use of weight retaining clips 15. As shown in FIGS. 1 and 3, each clip 15 is an elongated L-shaped member having two ends. The first end is fastened to the inside wall of an upper horizontal member; for example, as shown in FIGS. 1 and 3, a clip 15 is attached to the upper horizontal member 11A at a point 15P. In its resting position, the clip 15 is flush with the inside surface of the upper horizontal member 11A to which it is attached.

In its preferred embodiment, the second end of each clip has two appendages. As shown in FIGS. 1 and 3, the first appendage 15A is angled at 90° with respect to the length of the clip 15 such that the angled portion 15A protrudes into and obstructs the opening of the apertured region 14 associated with that clip. By obstructing the opening of the apertured region 14 the weight retaining clip 15 secures an additional weight 13 within the device 10 and prevents it from releasing from the device 10 while the device is in use. In other embodiments, the angled portion of the clip 15A can be positioned at any angle, so long as the angled portion of the clip 15A sufficiently obstructs the opening of the apertured region 14 and prevents the additional weight 13 from sliding out of the device 10 while it is in use.

To remove or insert an additional weight 13 the angled portion of the clip 15A must be temporarily removed from obstructing the opening of the apertured region 14. This can be accomplished by engaging the second appendage 15B (attached to the second end of the clip 15, as shown in FIG. 1) and pushing the second end of the clip sideways away from the inside surface of the upper horizontal member 11A to which the clip 15 is attached. By engaging the clip in this manner, the angled portion 15A is removed from the opening of the aperture 14 thereby allowing the easy insertion or removal of the weight 13. In its preferred embodiment, the appendage 15B extends above the top of the upper horizontal member 11A, as shown in FIGS. 1 and 2.

The weight retaining clips 15 are made of a material which has memory qualities, such as, metal or plastic. Thus, after a weight 13 is slideably removed from or inserted into an apertured region 14 within the housing 11, the inherent spring quality of the clip material forces the clip back to its initial resting position with the angled portion of the clip 15A obstructing the opening of the apertured region 14 within the housing 11 and the length of the clip flush with the inside surface of the upper horizontal member 11A. Alternatively, the additional weights 13' may be mounted onto the inside or outside surface of the housing 11 by snaps 24, as shown in FIG. 2.

Referring to FIG. 3, there is shown along the inner surface of the upper horizontal members 11A and 11A', means for securing the device 10 to a sports racquet 20. This securing means comprises two resilient elongated members 16 and 16' (also referred to hereinafter as "spring fingers") which are made of a resilient material like metal or plastic. As shown in FIG. 3, the first elongated member 16 is mounted to the inside surface of the upper horizontal member 11A, at a point 16P, near the longitudinal center of the member 11A. The elongated member 16 extends horizontally outward from point 16P (the member's point of attachment) to its two terminating ends 16A and 16B such that the member 16 spans the length of the inside surface of the upper member 11A. The second elongated member 16' is similar in structure to the first elongated member 16. It is also mounted to upper horizontal member 11A', at a point 16P', in the same fashion that member 16 is mounted on the opposite side of the housing 11 to member 11A.

As each member 16,16' horizontally extends from its attachment point 16P,16P' it also begins to angle away from the inside surface of the upper horizontal member 11A,11A' to which it is attached, as shown in FIG. 3. The angle is such that the terminating ends 16A and 16B of member 16 are spaced approximately one-quarter inch from the inside surface of the upper horizontal member 11A on one side, and approximately one-half inch from the corresponding ends 16A' and 16B' of the second elongated member 16' attached to the upper horizontal member 11A' on the opposite side of the housing 11.

The relative positions of the spring fingers 16 and 16', as shown in FIG. 3, allows the device 10 to accommodate the thickness of any size racquet that is slid between the spring fingers 16 and 16', while always providing sufficient force against the face of the racquet frame 20 to secure the device 10 into place. That is, when the device 10 is placed onto a sports racquet 20, the spring fingers 16 and 16' simultaneously separate to accommodate the thickness of the racquet frame 20 and resiliently bias against opposite sides of the racquet frame's facing. Thus, the spring fingers 16 and 16' pinch the sports racquet 20 near the bottom of the head 23 on the racquet's face areas (when the device 10 is properly positioned), thereby securing the device 10 to the sports racquet 20 at or near the racquet's center of gravity.

In other embodiments, the securing means can constitute any compliant surface attached to the inside surface of the housing 11, which is resiliently biased against the sports racquet 20, such as, but not limited to, a foam or rubber material. It should be noted that in other embodiments the securing means can be positioned anywhere along the inside surface of housing 11 which engages the sports racquet 20.

The spring fingers 16 and 16' (or inner compliant surface) are preferably constructed of a resilient material having a non-slip surface 17. In another embodiment, the spring fingers 16 and 16' (or inner compliant surface) can be covered with a non-slip surface 17, such as, but not limited to, a tacky pliable plastic coating. This serves not only to protect the surface of the frame 20 from scratches, marks or the like, but also ensures the device 10 will not slip down the throat 22 and handle 21 of the racquet 20 onto the user's hand when the racquet 20 is raised or positioned appropriately.

Although the present invention has been described with particular reference to a specific embodiment, it will be understood that various changes can be made in the form, construction and arrangement of the parts thereof without departing from the spirit and the scope of the invention or sacrificing all of its material advantages.

I claim:

1. A sports racquet weighting device for use with a sports racquet frame having a head, throat and handle, two opposing face areas, and a center of gravity comprising:

a. a housing, comprising first and second upper horizontal members, first and second lower horizontal members, each member having an inside and outside surface, means for connecting together the first upper and lower horizontal members, means for connecting together the second upper and lower horizontal members, and means for spacing apart the first and second upper horizontal members and the first and second lower horizontal members to define apertures adapted to receive the handle and throat of a sports racquet and dimensioned to constrain the device from passing over a head of a racquet;

b. an inner compliant surface attached to the inside surface of at least one horizontal member such that the inner compliant surface resiliently biases against, and slideably secures the device to a sports racquet frame; and c. means for securing at least one supplemental weight to the housing near the center of gravity of a sports racquet frame.

2. The sports racquet weighting device of claim 1 wherein the housing has a trapezoidal shape.

3. The sports racquet weighting device of claim 1 wherein the housing comprises high-impact plastic.

4. The sports racquet weighting device of claim 1 wherein the housing has at least one apertured region capable of receiving at least one supplemental weight.

5. The sports racquet weighting device of claim 1 wherein the inner compliant surface comprises at least one elongated member attached at its center to the inside surface of a horizontal member, the elongated member extending horizontally outward from its point of attachment, and angled away from the horizontal member to which it is attached such that the elongated member biases against and slideably secures the device to a sports racquet frame.

6. The inner compliant surface of claim 5 comprising at least two elongated members adapted to a pinch sports racquet frame on opposing sides of its face area.

7. The sports racquet weighting device of claim 5 wherein at least one elongated member has a non-slip surface.

8. The sports racquet weighting device of claim 1 wherein the inner compliant surface comprises a non-slip material.

9. The sports racquet weighting device of claim 1 wherein the means for securing at least one supplemental weight to the housing comprises at least one resilient elongated member having two ends, the first end connected to the inside surface of an upper horizontal member, and the second end having two appendages, the first appendage angled with respect to the length of the elongated member such that the angled portion of the elongated member obstructs the opening of an apertured region within the housing which accepts the supplemental weight, thereby slideably securing the supplemental weight within the apertured region within the housing, and the second appendage extending above the top portion of the housing.

10. The sports racquet weighting device of claim 1 further comprising at least one supplemental weight wherein each supplemental weight weighs approximately three to eight ounces each.

11. The sports racquet weighting device of claim 1 wherein the means for a securing at least one supplemental weight to the housing comprises snap means.

12. A sports racquet weighting device for use with a sports racquet frame having a head, throat and handle, two opposing face areas and a center of gravity comprising:

a. a housing of trapezoidal shape, made of high-impact plastic, having first and second lower horizontal members, each member having an inside and outside surface, and at least one side member joining the upper and lower horizontal members, the first and second upper horizontal members and the first and second lower horizontal members being spaced apart to define apertures adapted to receive a sports racquet;

b. at least one elongated member comprising non-slip resilient material attached at its center to the inside surface of a horizontal member, the elongated member extending horizontally outward from its point of attachment, and angled away from the horizontal member to which it is attached such that the elongated member biases against, and slideably secures the device to a sports racquet frame; and c. at least one supplemental weight and means for securing at least one supplemental weight of three to thirty ounces near the center of gravity of a sports racquet frame.

13. The sports racquet weighting device of claim 12 wherein the means for securing at least one supplemental weight near the center of gravity of a sports racquet frame comprises at least one resilient elongated member having two ends, the first end connected to the inside surface of an upper horizontal member, and the second end having two appendages, the first appendage angled with respect to the length of the elongated member such that the angled portion of the elongated member obstructs the opening of the apertured region which accepts the supplemental weight, thereby slideably securing the supplemental weight within the apertured region of the housing, and the second appendage extending above the top portion of the housing.

14. A sports racquet weighting device for use with a sports racquet frame having a head, throat and handle, two opposing face areas, and a center of gravity comprising:

a. a housing a trapezoidal shape, made of high-impact plastic, having first and second upper horizontal members, first and second lower horizontal members, each member having an inside and outside surface, means for connecting together the first upper and lower horizontal members, means for connecting together the second upper and lower horizontal members, and means for spacing apart the first and second upper horizontal members and the first and second lower horizontal members to define apertures adapted to receive the handle and throat of a sports racquet and dimensioned to constrain the device from passing over the head of a racquet;

b. at least one elongated member comprising non-slip resilient material attached at its center to the inside surface of a horizontal member, the elongated member extending horizontally outward from its point of attachment, and angled away from the horizontal member to which it is attached such that the elongated member biases against, and slideably secures the device to a sports racquet frame; and c. at least one supplemental weight and means for securing at least one supplemental weight of three to thirty ounces near the center of gravity of a sports racquet frame.

15. The sports racquet weighting device of claim 14 wherein the means for securing at least one supplemental weight near the center of gravity of a sports racquet frame comprises at least one resilient elongated member having two ends, the first end connected to the inside surface of an upper horizontal member, and the second end having two appendages, the first appendate angled with respect to the length of the elongated member such that the angled portion of the elongated member obstructs the opening of an apertured region within the housing which accepts the supplemental weight, thereby slideably securing the supplemental weight within the apertured region within the housing, and the second appendage extending above the top portion of the housing.

* * * * *